United States Patent [19]

Yamada et al.

[11] Patent Number: 4,818,449

[45] Date of Patent: Apr. 4, 1989

[54] PROCESS TO PREVENT CRACK FORMATION IN THE PRODUCTION OF CARBON FIBERS

[75] Inventors: Yasuhiro Yamada; Takeshi Imamura, both of Tosu; Hidemasa Honda, Tokyo; Masatoshi Tsuchitani; Ryoichi Nakajima, both of Ichihara, all of Japan

[73] Assignees: Itaru Todorok, Director-General of Agency of Industrial Science and Technology; Maruzen Petrochemical Co., Ltd., both of Tokyo, Japan

[21] Appl. No.: 818,499

[22] Filed: Jan. 13, 1986

[30] Foreign Application Priority Data

Jan. 19, 1985 [JP] Japan ..... 60-7699

[51] Int. Cl.[4] ..... D01F 9/12

[52] U.S. Cl. ..... 264/29.2; 264/29.6; 264/83; 264/176.1; 264/211.11; 264/211.14; 264/211.15; 425/467

[58] Field of Search ..... 264/211.21, 29.2, 29.6, 264/83, 176.1, 211.11, 211.14, 211.15; 425/467, 466; 423/447.4, 447.6

[56] References Cited

U.S. PATENT DOCUMENTS

| | | | |
|---|---|---|---|
| 4,076,481 | 2/1978 | Sansome | 425/467 |
| 4,331,620 | 5/1982 | Diefendorf et al. | 264/29.2 |
| 4,376,747 | 3/1983 | Nozen | 264/29.2 |
| 4,504,454 | 3/1985 | Rijgs | 264/29.2 |
| 4,576,811 | 3/1986 | Rijgs et al. | 264/29.2 |

FOREIGN PATENT DOCUMENTS

| | | | |
|---|---|---|---|
| 2017710 | 4/1969 | Fed. Rep. of Germany . | |
| 86717 | 7/1978 | Japan . | |
| 113292 | 7/1983 | Japan . | |
| 196292 | 11/1983 | Japan . | |
| 60-259609 | 12/1985 | Japan | 264/29.2 |
| 334039 | 12/1958 | Switzerland . | |
| 884465 | 12/1961 | United Kingdom . | |

*Primary Examiner*—Jan H. Silbaugh
*Assistant Examiner*—Hubert C. Lorin
*Attorney, Agent, or Firm*—Frishauf, Holtz, Goodman & Woodward

[57] ABSTRACT

When preparing carbon fibers from mesophase pitches, we usually encounter to the formation of cracks along the fiber axis. The crack formation is the most serious and troublesome problem. A simple process which can effectively prevent the crack formation comprises preparing the carbon fibers from mesophase pitches by melt spinning sufficient only to give a rotatory motion to the molten mesophase pitches just before extrusion substantially around the axis of a spinning nozzle hole. The process employs a usual nozzle plate having a pitch introducing tube and a spinning nozzle hole further containing a plug member having an outer spiral groove such as a drill point or a worm gear which is inserted within the pitch introducing tube.

10 Claims, 2 Drawing Sheets

PROCESS TO PREVENT CRACK FORMATION IN THE PRODUCTION OF CARBON FIBERS

BACKGROUND OF THE INVENTION

1. Field of the Invention

The present invention relates to a process for producing carbon fibers with high strength and high modulus of elasticity such as Young's modulus from mesophase pitches and also relates to an apparatus suitable for the practice of the process. More specifically, the present invention relates to an excellent economical process for producing high quality carbon fibers from mesophase pitches by melt spinning, wherein the pitch is spun while giving a rotatory motion to the pitch, and to a very simple spinning apparatus used for practice of the process. The characteristic feature of the apparatus of the present invention is that the apparatus contains a plug member having a spiral groove thereon, such as a drill point or a worm gear-like structure and the plug member is positioned within a path of pitch flow near a spinning nozzle hole so as to give a rotatory motion to the pitch.

In the specification, the words "pitch-based carbon fibers" means carbon fibers made from pitches.

Carbon fibers are useful materials, and they are recently attracting attention and gathering concern as an important material of the next generation. The carbon fibers may be classified into two groups: a high performance grade carbon fiber with high strength and high modules of elasticity which is used as composite materials in the fabrication of aircraft structures, sports goods, and the like, and a general purpose grade carbon fiber which is mainly used as heat insulator because of its low strength and modulus of elasticity.

2. Description of the Prior Art

High performance grade carbon fibers have been produced mainly by spinning a polyacrylonitrile (PAN) fiber, converting the PAN fiber to infusible state under oxidizing conditions, and subsequently carbonizing or graphitizing it under an inert atmosphere. In contrast to these PAN-based carbon fibers, pitch-based carbon fibers which are produced from pitches, have been regarded as unsuitable for use as structure materials because of their low strength and modulus of elasticity than PAN-based carbon fibers.

Recently however, pitch-based carbon fibers recurred attention because of the low cost of the starting material and because high yield are attainable when they are rendered infusible or carbonized. Vigorous studies are currently made concerning the process for producing of high performance carbon fibers from pitches as the starting material. Several processes have been proposed which permit production of pitch-based carbon fibers showing equal properties to those of PAN-based carbon fibers or even showing far superior modulus of elasticity.

Various processes for the production of pitch-based high performance carbon fibers have been elaborated: in one process (Japanese Patent Disclosure No. 196292/1983), pitches for spinning are produced by hydrogenation and subsequent thermal treatment; in another process (Japanese Patent Disclosure No. 113292/1983), pitches for spinning are produced by fractional solvent extraction of pitches and subsequent thermal treatment of specific fractions thus fractionated. In still another process (Japanese Patent Disclosure No. 86717/1983), pitches for spinning are produced by submitting pitches to a thermal treatment for a prolonged period of time at a relatively low temperature. A characteristic feature common to these processes is that all of the pitches for spinning are so-called mesophase pitch, which contain the mesophase showing an optical anisotropy when examined on a polarized light microscope as the main component.

The mesophases described above are liquid crystals and are formed on heating heavy oils, tars or pitches. In the specification, the words "heavy oil" means an oil having high boiling point and high specific gravity. It is considered that these mesophases shown an optical anisotropy because planar aromatic molecules, developed by thermal polymerization, are aligned in a layered structure. When fibers are produced from such mesophase pitches by melt spinning, the planar aromatic molecules are aligned parallel to the fiber axis by the stress exerted on passing through a spinning nozzle hole. This oriented structure is not disturbed and is maintained throughout the states of rendering the fibers infusible and their carbonization. Therefore, the carbon layers in the carbon fibers thus produced are also oriented along the fiber axis. Such highly oriented carbon fibers show high tensile strength, and when they are graphitized, they show high modulus of elasticity which is not attainable with PAN-based carbon fibers.

In order to improve the performance of pitch-based carbon fibers, it is essential to produce and to use mesophase pitches which will permit formation of well-oriented planar aromatic molecules during the spinning stage, and most of the prior proposals on the processes for the production of high performance carbon fibers relate to processes for the production of high quality mesophase pitches.

SUMMARY OF THE INVENTION

When fibers are spun with high quality mesophase pitches which induce well-oriented planar aromatic molecules, the molecules are oriented not only along the fiber axis, but also specifically on the cross section of the fiber. When a fiber is spun through an ordinary spinning nozzle hole with a circular cross section, it will produce a fiber with a circular cross section. When this cross section is examined, the planar aromatic molecules take the so-called radial orientation, which means that they are oriented radially from the center of the circle (Cf. FIG. 1). On carbonization, the planar aromatic molecules shrink to form carbon layers, while evaporating off volatile components. The degree of this shrinkage is markedly greater to the direction which is perpendicular to the plane of the planar aromatic molecules. Therefore, in the case of a fiber with a radial orientation, there is a large difference in the degree of shrinkage between that near the surface and that near the center of the fiber. This causes large cracks to take place along the fiber axis on carbonization (Cf. FIGS. 1 and 2), and drastically lowers the commercial value.

We also suffered from the crack formation along the fiber axis on carbonization, but after intensive studies aimed at solving these problems, we successfully came to the present invention.

Thus, we found that the cracks can be completely prevented by a simple process and the characteristic feature of the process comprises giving to the molten pitch just before the extrusion, a rotatory motion substantially around the axis of the spinning nozzle hole. We also found a spinning apparatus with a simple construction which is suitable to the practice of the process described above.

Therefore, the first object of the present invention is to provide a process for producing high performance pitch-based carbon fibers which can effectively prevent the crack formation, and the second object is to provide an apparatus for spinning of pitch-based carbon fibers which, though extremely simple in construction, can effectively prevent the crack formation.

Thus, the gist of the first invention resides in a process for producing carbon fibers from a mesophase pitch by melt spinning which comprises extruding a molten mesophase pitch through a spinning nozzle hole, rendering the extruded pitch fibers thus obtained to an infusible state by heating under an oxidizing atmosphere and then carbonizing or graphitizing them by heating under an inert atmosphere, characterized in that the spinning is performed by giving a rotatory motion to said molten mesophase pitch just before the extrusion substantially around the axis of said spinning nozzle hole; and the gist of the second invention resides in an apparatus for producing carbon fibers from a mesophase pitch by melt spinning comprising (a) a nozzle plate having a spinning nozzle hole and a pitch introducing tube which is connected in a substantialy coaxial way to said spinning nozzle hole, and (b) plug member having an outer spiral groove and the outer size of said plug member is substantially equal to the inner size of said pitch introducing tube, and said plug member is inserted to said pitch introducing tube.

DRAWINGS

FIG. 1 shows the orientation and cracks on a cross section of a pitch-based carbon fiber produced by a conventional method, wherein broken lines show the orientation of aligned carbon layers, and the right hand side of FIG. 2 is a side view of the fiber, and the left hand side thereof is a cross sectional view of the fiber showing schematically the alignment of carbon layers; FIG. 3 shows the orientation on a cross section of a pitch-based carbon fiber produced by the process of the present invention, wherein broken lines show the orientation of aligned carbon layers, and the right hand side of FIG. 4 is a side view of the fiber, and the left hand side thereof is a cross sectional view of the fiber showing schematically the alignment of carbon layers; and FIG. 5 shows a side view of an essential part of an example of the spinning apparatus of the present invention, which is partially written by a cross sectoinal view for the sake of a ready understanding of the structure.

DETAILED DESCRIPTION OF THE INVENTION

Figure 1:
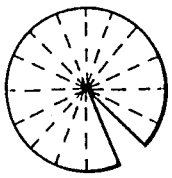
Fig. 1 PRIOR ART

Any mesophase pitch may be used as far as the pitches contain mesophase as the main component. The mesophase shows an optical anisotropy when examined on a polarized light microscope. The process of production of the mesophase pitch is not restricted to any specific process. Therefore, coal tar, naphtha tar, pyrolysis tar, decant oil, or pitchlike substances produced by distillation or thermal treatment of these heavy oils, or the like may be used as the starting material for the production of mesophase pitches.

As described before, several processes have been known to the art concerning the process of production of mesophase pitches. For example, a mesophase pitch with a low softening temperature and with good spinning properties may readily be produced by (1) hydrogenating a pitch by mixing 1 weight part of the pitch with 2–3 weight parts of tetrahydroquinoline and heating the mixture at 400°–450° C. under an autogeneous pressure, and then (2) subjecting the hydrogenated pitch to a brief thermal treatment at a high temperature with bubbling of an inert gas.

The spinning properties of mesophase pitches are greatly dependent upon the softening temperature and the ratio of constituents. Mesophase pitches with a very high softening temperature are not preferable because they require a high spinning temperature which causes degradation and decomposition of pitches. Even if pitches with a low softening temperatures are used, if they are such that their main components are isotropic materials and if mesophase materials are present a small amount and dispersed as spheres, they show poor spinning properties because the pitches become heterogeneous due to the large difference in the viscosities of the isoptropic and anisotropic materials in the spinning temperature range. When isotropic pitches which do not contain mesophase moiety are spun, it will not meet the object of the present invention, because the aromatic molecules in this case are not large enough to orient themselves distinctly by the stress on passing through the spinning nozzle hole. Preferred mesophase pitches are those which contain more than 60%, and more preferably more than 80% of components showing an optical anistropy when observed on a polarized light microscope. Mesophase pitches with softening temperature of 250°–320° C. are preferred.

It has been known to the art that the crack formation during conversion to infusible state, carbonization, or graphitization step of a spun pitch may be prevented by raising the spinning temperature, which induce the molecules within the fiber to take an onion-like orientation instead of a radial orientation. However, when mesophase pitches which themselves show high softening temperature of 250°–300° C. are spun by the process just described above, the spinning temperature should be maintained, at least, above 350° C. to prevent the crack formation. At this temperature, many organic compounds will decompose, and when degradation and decomposition of pitches are taken into account, it is not necessarily a prefered method to use a higher temperature in order to establish an onion-like orientation, since degradation and decomposition of the pitches give tremendous adverse effects on the properties of carbon fiber products. The use of a spinning nozzle hole with a complex cross section may also reduce the radial orientation of molecules and prevent the crack formation along the fiber axis at the carbonization stage. In this case, however, processing of a spinning nozzle hole require a special technique, and problems may arise concerning the precision of the spinning nozzle hole or cleaning up of the spinning nozzle after the use.

On the other hand, the process of the present invention can use a conventional spinning nozzle with a circular spinning nozzle hole, requires no further processing to the spinning nozzle hole itself, and yet it can shift the orientation of molecules within the fibers only by giving a rotatory motion to the pitch just before the extrusion, and in this way, can completely prevent the crack formation along the fiber axis at the carbonization or graphitization stage.

The means to give a rotatory motion to the pitch just before the extrusion are not restricted, but it is advantageous to use the apparatus of the present invention described below.

Thus, the simplest means to give a rotatory motion to a pitch just before the extrusion is to use a spinning apparatus in which a plug member with an outer spiral groove is inserted into the pitch introducing tube which is connected substantially coaxial with a spinning nozzle hole, the plug member substantially fitting into the pitch introducing tube.

The most preferred structure of the above apparatus is to use a pitch introducing tube having a circular cross section and a plug member having a circular cross section with the same or slightly smaller diameter as that of the pitch introducing tube. In this case, the shape of the plug member looks like a drill point or a worm gear.

Thus, when a simple construction is desired, it will be realized by connecting above the spinning nozzle hole, a pitch introducing tube with a diameter of a few mm and a length of ten and a few to a few tens mm, into which a conventional drill point commonly used as a tool or worm gear is inserted.

Figure 3:
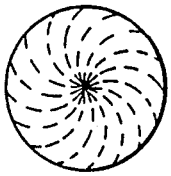
Figure 4:
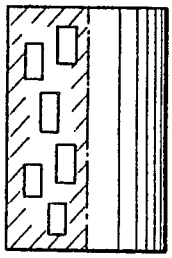

Generally, the diameter of a pitch introducing tube of a nozzle plate decreases as it nears the spinning nozzle hole and the top of the pitch introducing tube is conically shaped. The top of a drill point is also conically shaped but generally with an obtuse angle. Therefore, a small space can remain near the top of the pitch introducing tube, even after the insertion of a drill point into the pitch introducing tube. In general, drill groove is a very loose spiral with a pitch of a few mm per rotation. It was hardly predictable that such a slow rotation of the flow at a rate of a few mm per rotation in the pitch introducing tube would influence the orientation of the produced fibers, because it is believed that the molecules in the spun fibers are oriented by the stress at the spinning nozzle hole with a diameter as small as 0.1–0.5 mm. However, when fiber spun from the apparatus of this invention was carbonized or graphitized and its appearance was examined on a scanning electron microscope, it was found, as shown in FIGS. 3 and 4, that no crack formation occurred along the fiber axis. Further, as shown in FIG. 3, examination of the orientation of carbon layers on the cross section showed that even though the orientation looked like radial, it nevertheless was influenced by the effect of spiral rotation effect within the pitch introducing tube, and it was found to have a characteristic structure in which the orientation of carbon layer was curved as an impeller blade of a centrifugal pump.

It has not been elucidated fully why such a slow rotation, caused by a drill point inserted into a pitch introducing tube should result in such a remarkable effect. At present, we consider that as the cross sectional area is reduced to 1/10–1/000, usually 1/100–1/1000 in the conical portion of the pitch introducing tube, the flow would rotate very rapidly at the spinning nozzle hole in just the same manner as a flow rotates quite rapidly at the conical part of a cyclone separator.

It is as yet impossible to offer a precise reason why a shift of orientation from a radial to impeller-type can completely prevent crack formation at the carbonization stage, it may be assumed that the latter orientation has an effect similar to that of the onion-like orientation.

The present invention has a high commercial value because, by the use of the process and the spinning apparatus of the present invention, the crack formation at the carbonization stage, which was the most troublesome problem in the spinning of mesophase pitch, can easily be prevented. Moreover, the purpose of the present invention can be realized by use of a conventional nozzle plate without any special processing to the nozzle plate as far as it is equipped with a pitch introducing tube, by simply inserting into the pitch introducing tube, a plug member with a shape similar to a drill point. Also, the spinning nozzle hole can be cleaned up readily by the conventional method without any modification.

By the use of the process of the present invention, carbon fibers without crack formation can be constantly produced independently of the characteristics of the mesophase pitch employed, spinning conditions, and the conditions of conversion to infusible state and carbonization.

DESCRIPTION OF THE PREFERRED EMBODIMENT

Figure 5:
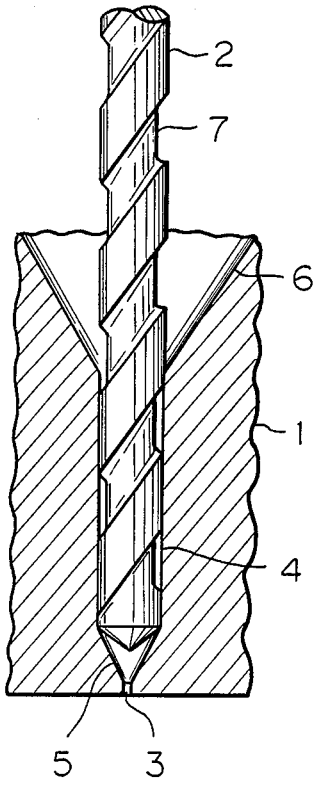

A preferred embodiment of the apparatus of the present invention is exemplified by FIG. 5. A side view of the structure of the essential part of an example of the spinning apparatus of the present invention is shown in FIG. 5, which partly shows a cross section for the sake of an easy understanding of the structure.

The spinning apparatus consists of a nozzle plate 1 and a plug member 2. In the Figure, for the convenience of explanation, the nozzle plate 1 is shown in a cross sectional view. A spinning nozzle hole 3 is provided at the top of a pitch introducing tube 4. The pitch introducing tube 4 forms a conically shaped part 5 near the spinning nozzle hole 3, and the other side of the pitch introducing tube 4 is expanded to form a funnel-shaped part 6. The outer diameter of the plug member 2 is made substantially equal to the inner diameter of the pitch introducing tube 4. A spiral groove 7 is provided along the outer surface of the plug member 2, and a molten pitch, pumped downward, is given a rotatory motion as it flows down along this spiral groove. In general, the apparatus of this invention has a spinning nozzle hole of 0.1 to 1 mm diameter and 0.5 to 1.5 mm length, above which is equipped with a pitch introducing tube with an inner diameter of 2 to 10 mm. More specifically, the apparatus shown in the Figure has a spinning nozzle hole of 0.25 mm diameter and 0.75 mm length, above which is equipped with a pitch introducing tube with an inner diameter of 2.5 mm. The cross sectional area of the pitch introducing tube is 10 to 1000 times of the cross sectional area of the spinning nozzle hole. The plug member 2 is a commercial drill point (Japanese Industrial Standard (JIS); straight shank drill) with an outer diameter of 2.5 mm. The pitch of the spiral groove of the plug member is 5 mm to 30 mm. The nozzle plate 1 was not processed specifically for the purpose of the present invention, but had been used formerly for spinning without insertion of a plug member 2 until the present invention.

The process of the present invention will be explained in more detail by the following Examples.

EXAMPLE 1

A coal tar pitch (200 g) and tetrahydroquinoline (400 g) was charged into a 1 liter autoclave and the mixture, after purging with nitrogen, was hydrogenated by heating for 30 min. at 420° C. under an autogeneous pressure. A hydrogenated pitch was obtained by filtration of the treated liquid to eliminate insoluble materials, followed by removal of the solvent under reduced pressure. This hydrogenated pitch (100 g) was charged to a 300 ml polymerization flask, and was heated for 10 min. in a molten salt bath at 510° C., then it was heated further for 105 min. in a molten salt bath at 440° C., during these heat treatments, a stream of nitrogen was bubbled through at a rate of 5 liter/min. This process afforded a pitch for spinning with a softening temperature of 268° C. On examination of this pitch on a polarized light microscope, it was found that the main component of the pitch is a mesophase showing an optical anisotropy, and a small amount of isotropic material was dispersed as spheres in the pitch.

The spinning apparatus comprising (a) a nozzle plate having a pitch introducing tube (internal diameter of 2.5 mm) which has a spinning nozzle hole (diameter of 0.25 mm and a hole length of 0.75 mm) at the top and (b) a drill point (JIS straight shank drill) having outer diameter of 2.5 mm which was positioned within the pitch introducing tube by insertion, shown in FIG. 5 was used. The mesophase pitch prepared above was charged into the spinning apparatus and pitch fibers were produced by spinning at a temperature of 34020 C. at a spin rate of 400 m/min. They were made infusible by heating up to 320° C. in the air, and then heated up to 1000° C. under an atmosphere of nitrogen to give carbon fibers. Fifty monofilaments were randomly taken out from the above carbon fiber sample and they were examined by scanning electron microscope at a magnification of 3000. It was found that they had an average diameter of 7.8 μ, and none of the above fifty samples showed the presence of cracks. The structure of the cross section of this sample had a impeller-type orientation as shown in FIG. 3.

Comparative Example 1

Pitch fibers were produced by spinning a mesophase pitch with a softening temperature of 268° C., produced by the same method as Example 1, by the same nozzle plate as Example 1 but without insertion of a drill point, at a temperature of 340° C. with a spinning rate of 400 m/min. They were made infusible and carbonized under the same conditions as those of example 1, and then fifth monofilaments were randomly taken out and their appearances were examined at a magnification of 3000. They had an average diameter of 7.9 μ, and 23 monofilaments out of fifty showed the presence of cracks to the direction parallel to the fiber axis. Because only one side of the sample could be examined by a scanning electron microscope, the fact that 23 out of fifty samples showed cracks may be considered as suggesting that almost all samples had cracks. The structure of the cross section of these samples had a radial orientation as shown in FIG. 1.

EXAMPLE 2

Two kinds of pitch fibers were produced by spinning the same mesophase pitch as Example 1 with a softening temperature of 268° C., by an apparatus with the same nozzle plate as Example 1 with insertion of the drill point, at a temperature of 340° C. with a spinning rate of 200 m and 100 m/min., respectively. When rendered infusible and carbonized under the same conditions as those of Example 1, the carbon fibers thus produced had average diameters of 9.9 μ and 12.4 μ, respectively. Each fifty monofilaments were randomly taken out from each sample, and their appearances were examined at a magnification of 3000. In each case, none showed cracks along the fiber axis.

EXAMPLE 3

Pitch fibers were produced from the same mesophase pitch as Example 1 with a softening temperature of 268° C., by an apparatus with the same nozzle plate as Example 1 with insertion of the drill point, at a temperature of 370° C. with a spinning rate of 500 m/min. After rendered infusible and carbonized under the same conditions as those of Example 1, fifty monofilaments were randomly taken out, and their appearances were examined at a magnification of 3000. The carbon fibers thus produced had an average diameter of 10.1 μ. None showed cracks along the fiber axis.

EXAMPLE 4

A spinning pitch with a softening temperature of 285° C. was produced by charging a hydrogenated pitch (200 g) which was hydrogenated by the same method as Example 1, into a 500 ml polymerization flask, heated for 10 min. in a molten salt bath kept at 510° C. and then heated for 1 hr. in a molten salt bath kept at 460° C. Pitch fibers were produced from this pitch by an apparatus with the same nozzle plate as Example 1 with insertion of the drill point, at a temperature of 350° C. with a spinning rate of 300 m/min. They were rendered infusible by heating up to 340° C. in the air, and carbonized at 1000° C. under the same conditions as those of Example 1. The carbon fibers thus produced had an average diameter of 11.6 μ. When the appearances of fifty monofilaments were examined in the same way as Example 1, none of the fifty monofilaments showed the presence of cracks.

EXAMPLE 5

Pitch fibers were produced from the same mesophase pitch as Example 1 with a softening temperature of 268° C., and by using a spinning apparatus with a spinning nozzle hole of 0.5 mm diameter and 1.0 mm length and a pitch introducing tube with an inner diameter of 2.5 mm to which was inserted the same drill point as Example 1, at a temperature of 340° C. with a spinning rate of 300 m/min. They were rendered infusible and carbonized under the same conditions as those of Example 4. The carbon fibers thus produced had an average diameter of 13.4 μ. When examined by the same way as Example 1, none of the fifty monofilaments showed the presence of cracks.

Figure 2:
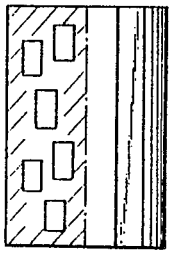
Fig. 2 PRIOR ART

The left hand side of FIG. 2 shows schematically the alignment of carbon layers in the carbon fiber of the Comparative Example 1 and the right hand side thereof shows the appearance of the fiber, and the left hand side of FIG. 4 shows schematically the alignment of carbon layers in the carbon fiber produced by Example 1 and the right hand side thereof shows the appearance of the fiber. Comparison of the two Figures shows that the general patterns of the alignment of carbon layers is similar to each other in that the carbon layers are aligned parallel to the fiber axis. However, as seen in FIGS. 1 and 3, they differ each other in that while the aligned layers are oriented radially in FIG. 1 (Comparative Example 1), they have a curved orientation in a impeller-type in FIG. 3 (Example 1).

We claim:

1. A process for producing carbon fibers from a mesophase pitch by melt spinning which comprises extruding in a molten mesophase pitch through a spinning nozzle hole, rendering the extruded pitch fibers thus obtained into an infusible state by heating under an oxidizing atmosphere and then carbonizing or graphitizing said pitch fibers by heating under an inert atmosphere, wherein the spinning is accomplished by constraining said pitch to flow through a plug means forming a spiral passage substantially around the axis of said spinning nozzle hole to give a rotary motion to said molten mesophase pitch just before extruding said pitch through said nozzle hole, to thereby effectively prevent crack formation in said fibers.

2. The process as claimed in claim 1, wherein said mesophase pitch has a mesophase content of 60 to 100%.

3. The process as claimed in claim 1, wherein said mesophase pitch has a mesophase content of 80 to 100%.

4. The process as claimed in claim 1, wherein said mesophase pitch has a softening temperature of 250°-320° C.

5. The process as claimed in claim 1 wherein said pitch is constrained to flow through a spiral passage formed by contacting an inner side of a pitch introducing tube and said plug means which comprises a plug member having an outer spiral groove.

6. The process as claimed in claim 5, wherein said pitch introducing tube is provided with a cross-sectional area 10 to 1000 times the cross sectional area of said spinning nozzle hole.

7. The process as dclaimed in claim 6, wherein the pitch of said spiral groove of said plug member is 5 mm to 30 mm and the outer size of said plug member is 2 mm to 10 mm.

8. The process as claimed in claim 5, wherein the cross section of said pitch introducing tube and said spinning nozzle hole are circular and said plug member is a drill point or a worm gear.

9. The process as claimed in claim 8, wherein said plug member is a drill point.

10. The process as claimed in claim 5, wherein the pitch of said spiral groove of said plug member is 5 mm to 30 mm and the outer size of said plug member is 2 mm to 10 mm.

* * * * *